US005294035A

United States Patent [19]

Asai et al.

[11] Patent Number: 5,294,035

[45] Date of Patent: Mar. 15, 1994

[54] RATCHET DEVICE HAVING A STOPPER MEMBER FOR PREVENTING EXCESSIVE ROTATION OF RATCHET WHEEL, AND TAPE FEEDING APPARATUS USING THE RATCHET DEVICE

[75] Inventors: Koichi Asai, Nagoya; Mamoru Tsuda, Okazaki; Shinsuke Suhara, Kariya, all of Japan

[73] Assignee: Fuji Machine Mfg. Co., Ltd., Aichi, Japan

[21] Appl. No.: 878,524

[22] Filed: May 5, 1992

[30] Foreign Application Priority Data

May 11, 1991 [JP] Japan ..... 3-135626

[51] Int. Cl.[5] ..... B65H 20/00

[52] U.S. Cl. ..... 226/157; 74/577 S; 74/128; 74/142; 74/577 M

[58] Field of Search ..... 400/572, 573, 575; 226/157; 74/577 S, 128, 142, 141.5, 577 M, 577 R

[56] References Cited

U.S. PATENT DOCUMENTS

| | | | |
|---|---|---|---|
| 687,620 | 11/1901 | Goodwin | 74/577 S X |
| 2,290,041 | 7/1942 | Gautier | 226/157 |
| 2,414,112 | 1/1947 | Malone et al. | 74/577 X |
| 3,172,592 | 3/1965 | Norden | 226/157 |
| 3,978,736 | 9/1976 | Igelhaut | 226/157 X |
| 4,307,832 | 12/1981 | Taki et al. . | |
| 4,327,482 | 5/1982 | Araki et al. . | |
| 4,440,355 | 4/1984 | Mori et al. . | |
| 4,664,306 | 5/1987 | Levy | 226/157 X |
| 4,740,136 | 4/1988 | Asai et al. . | |
| 4,955,556 | 9/1990 | Frisk | 74/577 S X |

FOREIGN PATENT DOCUMENTS

| | | |
|---|---|---|
| 57-33141 | 2/1982 | Japan . |
| 59-39999 | 3/1984 | Japan . |
| 60-194397 | 12/1985 | Japan . |
| 61-33466 | 2/1986 | Japan . |

*Primary Examiner*—Clifford D. Crowder
*Assistant Examiner*—Paul C. Lewis
*Attorney, Agent, or Firm*—Oliff & Berridge

[57] ABSTRACT

A ratchet device is disclosed which includes a body, a ratchet wheel rotatably supported by the body, a feed pawl having an engaging portion engageable with teeth of the ratchet wheel, a support member for holding the feed pawl, a member for biasing the feed pawl toward the wheel teeth, and a drive device for moving reciprocating the support member between two positions to place the feed pawl alternately in its fully advanced and retracted positions, so as to rotate the ratchet wheel a predetermined angle in one direction. The ratchet device further includes a stopper member for contact with the feed pawl when the pawl is placed in the fully retracted position, to thereby prevent the engaging portion of the pawl from disengaging from the teeth of the ratchet wheel. Further, the engaging portion of the feed pawl is shaped so that it engages mutually opposed faces of the ratchet wheel when the feed pawl is in contact with the stopper member, to thereby lock the ratchet wheel against clockwise and counterclockwise rotations thereof. Also disclosed is a tape feeding apparatus which utilizes the ratchet device.

21 Claims, 5 Drawing Sheets

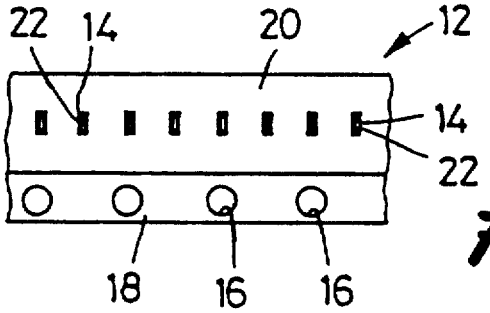
FIG. 4
FIG. 5
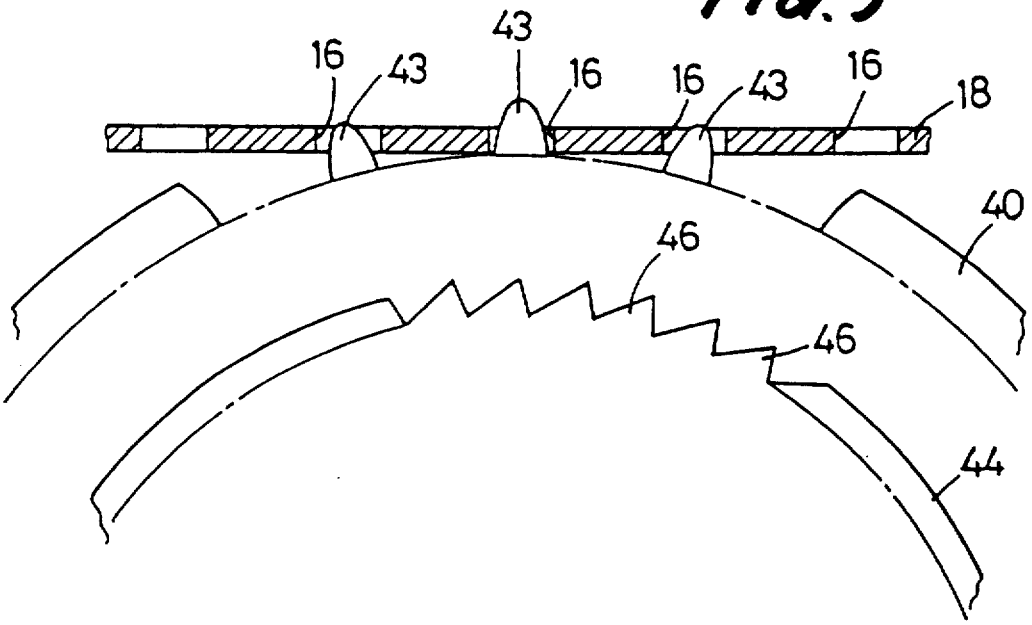

RATCHET DEVICE HAVING A STOPPER MEMBER FOR PREVENTING EXCESSIVE ROTATION OF RATCHET WHEEL, AND TAPE FEEDING APPARATUS USING THE RATCHET DEVICE

BACKGROUND OF THE INVENTION

1. Field of the Invention

The present invention relates to a ratchet device for effecting intermittent rotation of a ratchet wheel, and more particularly to such a ratchet device which is capable of controlling a rotating angle of the wheel with improved angular positioning accuracy. The present invention is also concerned with a tape feeding apparatus which includes such a ratchet device.

2. Discussion of the Prior Art

The ratchet device as described above generally includes: (a) a body; (b) a ratchet wheel rotatably supported by the body and having teeth; (c) a feed pawl having an engaging portion engageable with the teeth of the ratchet wheel; (d) a support member movably supported by the body, for movably holding the feed pawl such that the engaging portion is movable in a direction toward and away from the teeth of the ratchet wheel; (e) biasing means for biasing the feed pawl toward the teeth of the ratchet wheel for engagement of the engaging portion with the teeth; and (f) drive means for moving the support member between a first position for placing the feed pawl in a fully advanced position, and a second position for placing the feed pawl in a fully retracted position. In the thus constructed ratchet device, when the support member is moved from the second position to the first position, the feed pawl is advanced so that its engaging position passes or clicks past at least one of the teeth of the ratchet wheel. When the support member is moved from the first position to the second position, the feed pawl is retracted while engaging the last one of the above-indicated at least one tooth which the engaging portion has passed last, so as to rotate the ratchet wheel a predetermined angle corresponding to the number of the above-indicated at least one tooth. The number of the teeth the engaging portion of the feed pawl passes during one stroke of the support member is determined by the distance of the movement of the support member, which in turn is determined depending upon a desired rotating angle of the ratchet wheel.

The ratchet device constructed as described above may be used for intermittently rotating a rotary member about an axis thereof by a predetermined incremental angle at a time, or intermittently moving a linearly movable member by a predetermined incremental distance at a time. For example, the ratchet device is used for intermittently feeding a carrier tape which has a substrate having pockets receiving electronic components, and a covering film for covering the substrate so as to close the pockets. In this case, the ratchet device serves to intermittently rotate a sprocket wheel whose teeth are adapted to engage feed holes or perforations formed through the carrier tape.

In the known ratchet device as described above, however, the ratchet wheel tends to be excessively rotated due to the inertia thereof or that of the movable member connected to the ratchet wheel when the support member is moved from the first position to the second position to rotate the ratchet wheel. Consequently, the movable member is moved more than the predetermined or nominal distance.

SUMMARY OF THE INVENTION

It is therefore a first object of the present invention to provide a ratchet device which is capable of rotating a ratchet wheel with significantly improved angular positioning accuracy.

A second object of the invention is to provide a feeding apparatus for feeding a carrier tape as described above, which includes such a ratchet device.

The above object may be attained according to the principle of the present invention, which provides a ratchet device comprising: (a) a body; (b) a ratchet wheel rotatably supported by the body and having a plurality of teeth; (c) a feed pawl having an engaging portion engageable with the teeth of the ratchet wheel; (d) a support member movably supported by the body, for movably holding the feed pawl such that the engaging portion is movable in a direction toward and away from the teeth of the ratchet wheel; (e) biasing means for biasing the feed pawl toward the teeth of the ratchet wheel for engagement of the engaging portion with the teeth; (f) drive means for moving the support member between a first position for placing the feed pawl in a fully advanced position, and a second position for placing the feed pawl in a fully retracted position, the engaging portion of the feed pawl passing at least one of the teeth of the ratchet wheel when the support member is moved from the second position to the first position, and rotating the ratchet wheel in one direction by a predetermined angle corresponding to the number of the above-identified at least one of the teeth, while engaging a last tooth of the above-identified at least one of the teeth which the feed pawl has passed last, when the support member is moved from the first position to the second position; (g) a stopper member provided on the body, for contact with the feed pawl when the support member is placed in the second position, for preventing the engaging portion of the feed pawl from disengaging from the last tooth of the ratchet wheel; and (h) the engaging portion of the feed pawl being shaped so that the engaging portion engages mutually opposed tooth faces of the ratchet wheel when the feed pawl is held in contact with the stopper member, to thereby lock the ratchet wheel against clockwise and counterclockwise rotations thereof.

In the ratchet device constructed as described above, the feed pawl is adapted to rotate the ratchet wheel while engaging the last tooth of the wheel the feed pawl has passed, when the support member is moved from the first position (corresponding to the fully advanced position of the pawl) toward the second position (corresponding to the fully retracted position of the pawl). When the support member reaches the second position, the feed pawl comes into contact with the stopper member, whereby the engaging portion of the feed pawl is kept from disengaging from the teeth of the ratchet wheel. In this condition, the engaging portion is held in engagement with the mutually opposed faces of two adjacent teeth, to prevent clockwise and counterclockwise rotations of the ratchet wheel relative to the feed pawl. Therefore, the ratchet wheel is completely stopped at the predetermined angular position, with the feed pawl held in contact with the stopper member. Although the ratchet wheel tends to continue to rotate due to the inertia even after the support member and the feed pawl are stopped, the excessive rotation of the wheel is prevented due to engagement of the engaging portion with the opposed faces of the adjacent teeth of the wheel, and by contact of the feed pawl with the stopper member. Namely, the ratchet wheel is stopped exactly at a position corresponding to the nominal fully retracted position of the feed pawl, after the wheel is rotated a predetermined angle which exactly corresponds to the number of the teeth the pawl has passed. Thus, the ratchet wheel can be rotated the predetermined angle with high accuracy, without an overrun of the engaging portion of the feed pawl.

As described above, the ratchet device of the present invention is able to intermittently rotate the ratchet wheel with significantly improved angular positioning accuracy. Accordingly, the present ratchet device is advantageously utilized to intermittently move or rotate a desired member, such as a carrier tape carrying electronic components, by a given incremental distance or angle. Further, the above object may be achieved at a relatively low cost simply by providing the stopper member on the device and appropriately shaping the engaging portion of the feed pawl.

The above-indicated mutually opposed tooth faces may consist of mutually facing tooth faces of two adjacent teeth of the ratchet wheel. In this case, the two adjacent teeth consist of the above-indicated last tooth and a tooth adjacent to the last tooth in a direction opposite to the above-indicated one direction.

Alternatively, the mutually opposed tooth faces may consist of opposite tooth faces of one tooth of the ratchet wheel.

The second object indicated above may be attained according to a second aspect of this invention, which provides an apparatus for feeding a carrier tape which has electronic components spaced apart from each other in a longitudinal direction of the carrier tape, the carrier tape having equi-spaced feed holes arranged in the longitudinal direction, the apparatus comprising: (a) a body; (b) a sprocket wheel rotatably supported by the body and having a plurality of teeth engageable with the feed holes of the carrier tape; (c) a ratchet wheel rotatably supported by the body and having a plurality of teeth, the ratchet wheel being connected to the sprocket wheel, for rotating the sprocket wheel; (d) a feed pawl having an engaging portion engageable with the teeth of the ratchet wheel; (e) a support member movably supported by the body, for movably holding the feed pawl such that the engaging portion is movable in a direction toward and away from the teeth of the ratchet wheel; (f) biasing means for biasing the feed pawl toward the teeth of the ratchet wheel for engagement of the engaging portion with the teeth; (g) drive means for moving the support member between a first position for placing the feed pawl in a fully advanced position, and a second position for placing the feed pawl in a fully retracted position, the engaging portion of the feed pawl passing at least one of the teeth of the ratchet wheel when the support member is moved from the second position to the first position, and rotating the ratchet wheel in one direction by a predetermined angle corresponding to the number of the above-indicated at least one of the teeth, while engaging a last tooth of the above-indicated at least one of the teeth which the feed pawl has passed last, when the support member is moved from the first position to the second position; (h) a stopper member provided on the body, for contact with the feed pawl when the support member is placed in the second position, for preventing the engaging portion of the feed pawl from disengaging from the last tooth of the ratchet wheel; and (i) the engaging portion of the feed pawl being shaped so that the engaging portion engages mutually opposed tooth faces of the ratchet wheel when the feed pawl is held in contact with the stopper member, to thereby lock the ratchet wheel against clockwise and counterclockwise rotations thereof.

The tape feeding apparatus constructed as described above is capable of accurately positioning the carrier tape by intermittently feeding the carrier tape, since the present tape feeding apparatus uses a ratchet device which has the advantages as described above with respect to the first aspect of the invention.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which:

FIG. 4 is a top plan view showing the carrier tape to be fed by the feeding apparatus of FIG. 1;

FIG. 5 is a front view showing a part of a sprocket wheel of the feeding apparatus of FIG. 1, when the wheel engages feed holes formed through the carrier tape.

DETAILED DESCRIPTION OF THE PREFERRED EMBODIMENT

Figure 1:
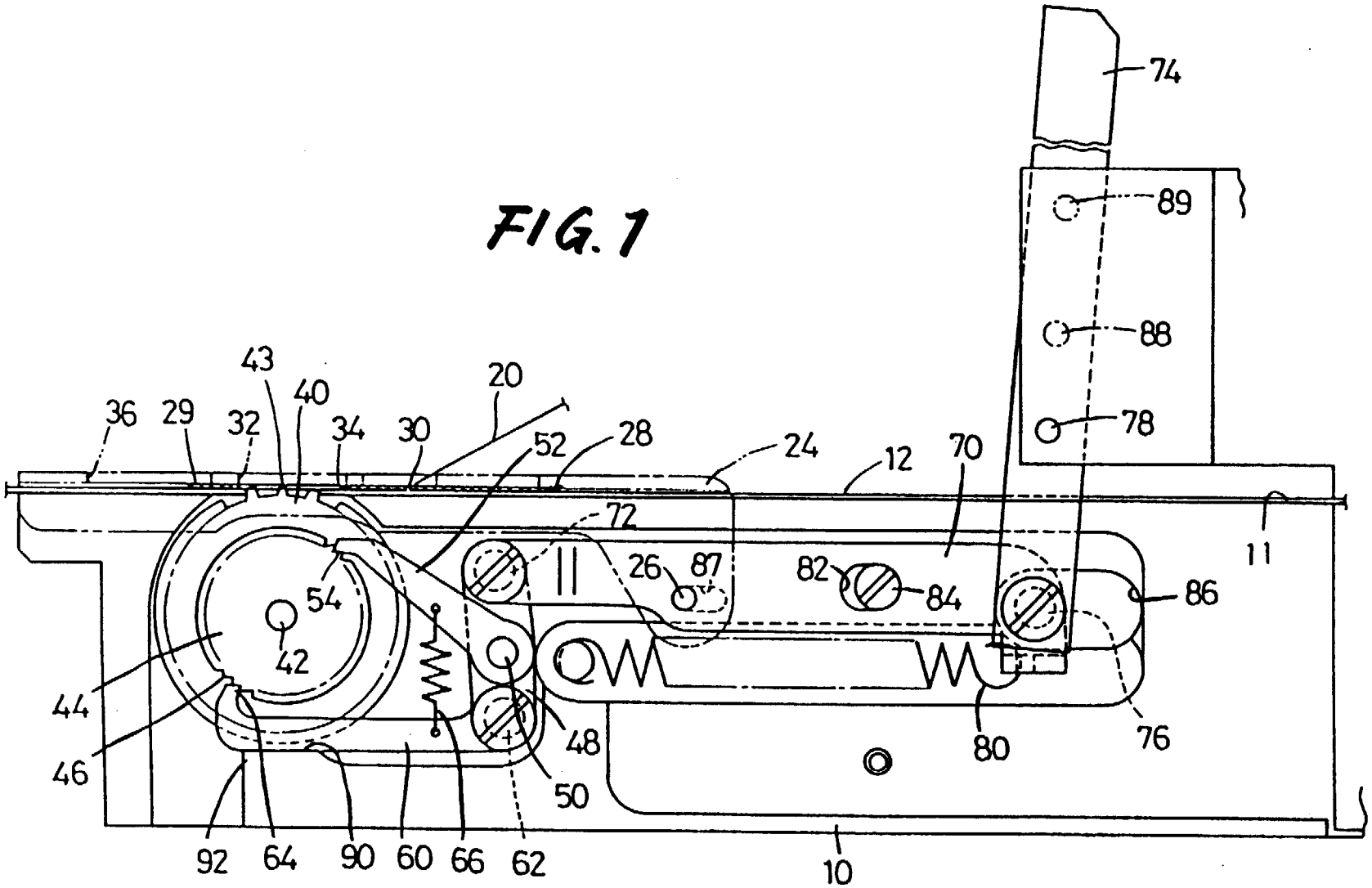
FIG. 1 is a front elevational view showing a feeding apparatus for feeding a carrier tape carrying electronic components, the apparatus including a ratchet device as one embodiment of the present invention.
Figure 2:
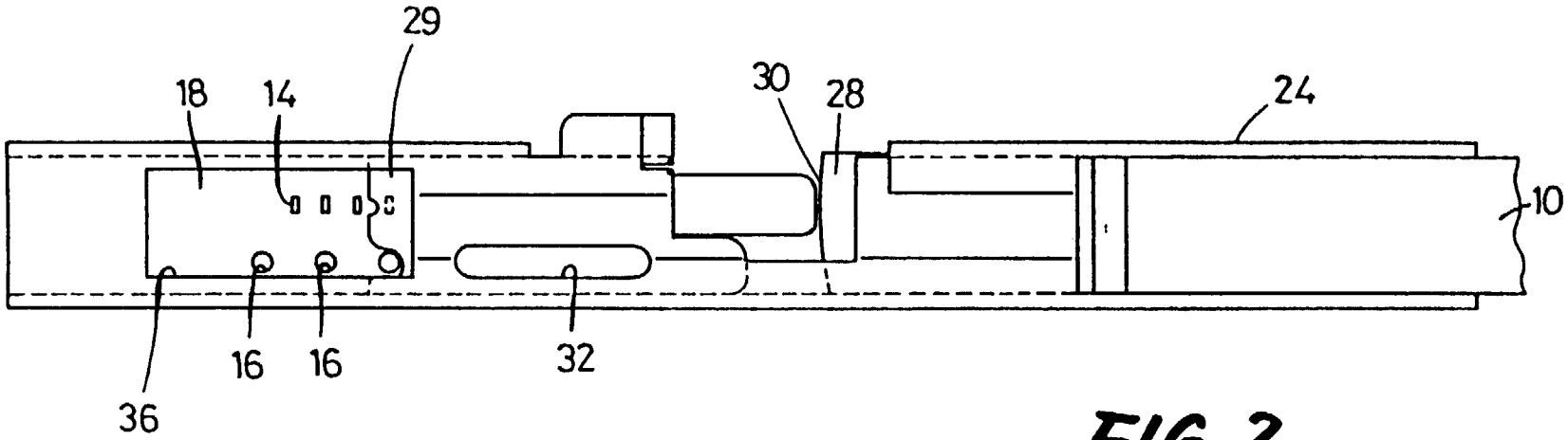
FIG. 2 is a top plan view of the feeding apparatus of FIG. 1.
Figure 3:
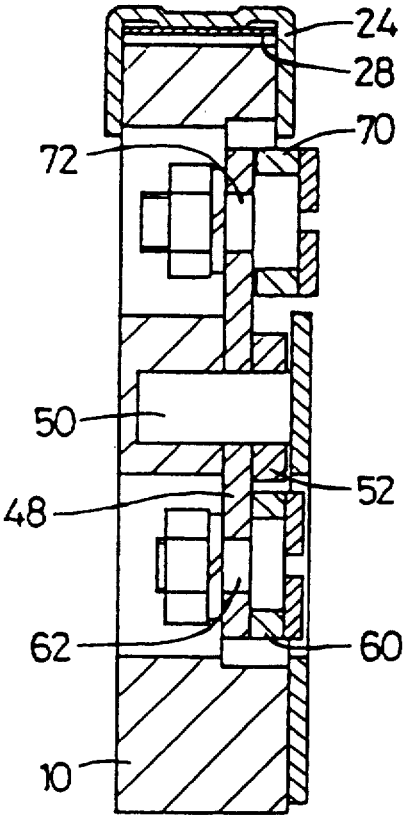
FIG. 3 is a side elevational view in cross section of the feeding apparatus of FIG. 1.

Referring first to FIGS. 1-3, there is shown one embodiment of a ratchet device of the present invention, which is adapted for use in an apparatus for intermittently feeding a carrier tape 12 carrying electronic components. In FIG. 1, reference numeral 10 denotes a body of the feeding apparatus, which is a block-like member having a relatively small width as seen in FIGS. 2 and 3. This body 10 has a top sliding surface 11 o which the carrier tape 12 is slidably fed in a longitudinal direction thereof. As shown in detail in FIG. 4, the carrier tape 12 consists of a substrate 18 having a row of pockets 14 and a row of feed holes 16, and a thin transparent covering film 20 attached to the top face of the substrate 18, so that the pockets 14 are closed by the film 20. The pockets 14 are equally spaced apart in the longitudinal direction of the carrier tape 12 at a pitch of 2 mm, and are adapted to accommodate electronic components or chips 22 having no leads. The feed holes 16 are equally spaced apart in the above longitudinal direction at a pitch of 4 mm. With the electronic components accommodated in the pockets 14 enclosed by the covering film 20, the carrier tape 12 is wound on a supply reel (not shown).

A portion of the sliding surface 11 of the body 10 is covered with a cover 24 which is pivotable about a shaft (axis) 26. The cover 24 has a generally U-shaped cross section, and its widthwise central portion slightly protrudes downward, as seen in FIG. 3. Presser plates 28, 29 are fixed to the lower surface of the central portion of the cover 24. In operation, the carrier tape 12 is fed through a clearance between the sliding surface 11 and the presser plates 28, 29. Between the presser plates 28 and 29, there is provided an opening 30 extending in a direction perpendicular to the longitudinal or feeding direction of the carrier tape 12, as shown in FIG. 2. The portion of the covering film 20, which has been removed off the substrate 18, passes through the opening 30, and is then wound up on a take-up reel (not shown). The cover 24 and presser plate 29 have respective elongate apertures 32, 34, which are formed through their portions corresponding to the feed holes 16 of the substrate 18. Further, the cover 24 is formed at its leading end portion with a rectangular opening 36, through which the electronic components 22 are picked up from the substrate 18 by means of a suction pipe.

The feeding apparatus further includes a sprocket wheel 40 which is attached to the body 10 through a shaft 42 such that the wheel 40 is rotatable about the shaft 42 having a horizontal axis perpendicular to the feeding direction of the carrier tape 12. Teeth 43 of the sprocket wheel 40 are adapted to engage the feed holes 16 formed through the substrate 18, as shown in FIG. 5, so as to feed the carrier tap 12 in its longitudinal direction by counterclockwise rotation of the sprocket wheel 40. To the sprocket wheel 40 is fixedly attached a ratchet wheel 44 having a smaller diameter than the wheel 40, such that the ratchet wheel 44 is disposed coaxially with the sprocket wheel 40, for rotation about the common axis 42. It will be understood that the body 10 of the feeding apparatus serves also as a body of the instant ratchet device having the ratchet wheel 44. The number of teeth 46 of the ratchet wheel 44 is determined so that the carrier tape 12 is fed 2 mm by the sprocket wheel 40 while the ratchet wheel 44 is rotated by an angle which corresponds to one of the teeth 46 thereof, i.e., which corresponds to the pitch of the teeth 46.

The body 10 further has a support member in the form of a support lever 48 attached thereto such that the lever 48 is pivotable about a shaft 50 having a horizontal axis parallel to the axis of rotation of the sprocket wheel 40. A detent pawl 52 is pivotably connected to the support lever 48 through the shaft 50, and is formed at its distal end with a tip 54 which is engageable with the teeth 46 of the ratchet wheel 44. To the lower end portion of the support lever 48 is connected a feed pawl 60 through a shaft 62, such that the feed pawl 60 is pivotable about the shaft 62 whose axis is parallel to that of the shaft 50. The feed pawl 60 is formed at its distal end with a tip 64 which is engageable with the teeth 46 of the ratchet wheel 44. The detent and feed pawls 52, 60 are biased toward each other by biasing means in the form of a spring 66 so that the tips 54, 64 are held in engagement with the teeth 46 of the ratchet wheel 44.

To the upper end portion of the support lever 48 remote from the feed pawl 60, there is connected a front end portion (on the side of the ratchet wheel 44) of a drive plate 70 through a shaft 72, such that the plate 70 is pivotable about an axis of the shaft 72 which is parallel to that of the shaft 50. A drive bar 74 is connected at its lower end portion to the rear end portion (remote from the ratchet wheel 44) of the drive plate 70 through a shaft 76, such that the bar 74 is pivotable about an axis of the shaft 76 parallel to the shaft 50. This drive bar 74 is pivotably supported by the body 10 through a shaft 78, and is adapted to be pivoted or rotated a predetermined angle by a suitable cam (not shown), in the counterclockwise direction as seen in FIG. 1. Between the rear end portion of the drive plate 70 and the body 10, there is provided a spring 80 for biasing the drive plate 70 toward its fully advanced position (which will be described), i.e., toward the ratchet wheel 44. The drive plate 70 has an elongate hole 82 formed therethrough, which is elongated in the longitudinal direction of the plate 70. This hole 82 is adapted to receive a pin 84 fixed on the body 10, so that the pin 84 is slidable in the hole 82 upon longitudinal movement of the drive plate 70. Thus, the drive plate 70 is placed in the fully advanced position under the biasing action of the spring 80, which position is determined by abutting contact of the pin 84 with the plate 70, more precisely, with its portion defining the rear end of the hole 82. In FIG. 1, reference numeral 86 denotes an elongate hole formed through the body 10, for receiving the shaft 76 to avoid interference between the body 10 and the shaft 76. Further, reference numeral 87 denotes an elongate hole formed through the drive plate 70. The shaft 26 for supporting the cover 24 extends through the hole 87 to avoid interference between the plate 70 and the shaft 26 upon the longitudinal movement of the plate 70.

When the drive bar 74 is pivoted by the cam in the counterclockwise direction as viewed in FIG. 1, the drive plate 70 is retracted from the fully advanced position and the support lever 48 is pivoted clockwise, whereby the feed pawl 60 is advanced, i.e., moved to the left as viewed in FIG. 1, so that the tip 64 passes or clicks past at least one of the teeth 46 of the ratchet wheel 44. With the drive bar 74 disengaged from the cam, the drive plate 70 is moved to the fully advanced position under the biasing action of the spring 80, and the support lever 48 is pivoted counterclockwise, whereby the feed pawl 60 is retracted or moved to the right so as to rotate the ratchet wheel 44. In the instant embodiment, the drive plate 70, drive bar 74, spring 80 and other components constitute drive means for moving the support lever 48 between a first position for placing the feed pawl 60 in its fully advanced position, and a second position for placing the feed pawl 60 in its fully retracted position. When the support lever 48 is placed in the second position, the pin 84 abuts on the rear end wall of the elongate hole 82 of the drive plate 70. When the support lever 48 is placed in the first position, the tip 64 of the feed pawl 60 engages the tooth 46 of the ratchet wheel 44 which the tip 64 has just passed. The drive bar 74 may be pivotably attached to the body 10 through a shaft 88 or a shaft 89, which are located nearer to the upper end of the bar 74 than the shaft 78. The distance of reciprocatory pivotal movement of the lower end portion of the drive bar 74, which determines the amount of pivotal movement of the support lever 48, is determined depending upon a selected one of the shafts 78, 88, 89 about which the bar 74 is pivoted. In the following description, it is assumed that the shaft 78 is selected to establish the minimum amount of movement of the drive bar 74, so that the feed pawl 60 passes only one tooth 46 of the ratchet wheel 44 during one stroke of the drive bar 74.

The body 10 is provided with a stopper member 92 located below the ratchet wheel 44. The stopper member 92 has a horizontal stopper surface 90, which is adapted for contact with the lower surface of the feed pawl 60 when the pawl 60 is moved to its fully retracted position as a result of the counterclockwise pivotal movement of the support lever 48. This stopper surface 90 is suitably positioned so as to prevent the tip 64 of the feed pawl 60 from disengaging from the teeth 46 of the ratchet wheel 44. Further, the tip 64 of the feed pawl 60 is suitably shaped or dimensioned so that the tip 64 can pass the appropriate tooth 46 of the ratchet wheel 44 when the feed pawl 60 is moved to its fully advanced position, and so that the tip 64 engages a groove between the mutually opposed faces of the appropriate two adjacent teeth 46 while the feed pawl 60 is held in contact with the stopper surface 90, so as to lock the wheel 44 against clockwise and counterclockwise rotations.

In operation of the thus constructed feeding apparatus for feeding the carrier tape 12, the support lever 48 is pivoted clockwise as viewed in FIG. 1, so that the tip 64 of the feed pawl 60 passes one of the teeth 46 of the ratchet wheel 44 and engages this one tooth and the adjacent tooth 46. Although a clockwise moment is applied to the ratchet wheel 44 when the tip 64 passes the one tooth 46, the wheel 44 is prevented from rotating clockwise due to engagement of the detent pawl 54 with the wheel 44. The teeth 46 of the ratchet wheel 44 are shaped so that the tip 64 can pass the teeth 46 even while the clockwise rotation of the ratchet wheel 44 is prevented by the detent pawl 52. In other words, while the feed pawl 60 is in contact with the stopper surface 90 with the support lever 48 placed in the second position, the position of the tip 64 engaging the groove between the adjacent two teeth 46 of the ratchet wheel 44 is determined so that the tip 64 can pass the relevant tooth 46 when the support lever 48 is pivoted to the first position even while the clockwise rotation of the ratchet wheel 44 is prevented. However, the detent pawl 52 may be eliminated. In this case, the ratchet wheel 44 is permitted to rotate clockwise as viewed in FIG. 1, during the leftward movement of the feed pawl 60 toward the fully advanced position, and the tip 64 can be disengaged from the groove between the adjacent teeth 46 and pass one of the adjacent teeth 46. In this case, it is not essential that the shape of the teeth 46, and the engaging position of the tip 64 and the teeth 46 are determined as described above.

When the support lever 48 is moved to the first position to place the feed pawl 60 in the fully advanced position, the tip 64 of the pawl 60 engages one tooth 46 of the ratchet wheel 44 adjacent the tooth 46 which the tip 64 has just passed. Then, the support lever 48 is pivoted counterclockwise as viewed in FIG. 1 to move the feed pawl 60 toward the fully retracted position, whereby the ratchet wheel 44 is rotated counterclockwise with the sprocket wheel 40. Consequently, the carrier tape 12 is fed by the counterclockwise rotation of the sprocket wheel 40.

When the support lever 48 is moved to the second position to bring the feed pawl 60 into the fully retracted position, the lower surface of the feed pawl 60 comes into contact with the stopper surface 90 so that tip 64 of the pawl 60 is prevented from moving away from the teeth 46 of the ratchet wheel 44. Namely, with the counterclockwise rotation of the support lever 48, the feed pawl 60 is moved downward while being retracted, to rotate the ratchet wheel 44, until the downward movement of the pawl 60 is inhibited by its contact with the stopper surface 90. While the feed pawl 60 is held in contact with the stopper surface 90, the tip 64 is located in the groove between the two adjacent teeth 46 while engaging two mutually opposed faces of these teeth 46 so as to lock the ratchet wheel 44 against the clockwise or counterclockwise rotation thereof. Upon contact of the feed pawl 60 with the stopper surface 90, therefore, the ratchet wheel 44 can be completely stopped without any further counterclockwise rotation occurring due to the inertia of the ratchet wheel 44 per se and the inertia of the sprocket wheel 40. Namely, the ratchet wheel 44 is rotated an angle exactly corresponding to one tooth 46, and is stopped with high accuracy at an angular position where the support lever 48 is placed in the second position with the feed pawl 60 in the fully retracted position. Thus, the carrier tape 12 carrying the electronic components is fed exactly in increments of 2 mm by the instant ratchet device. It is to be understood that the tip 54 of the detent pawl 52 is adapted to pass the teeth 46 during the counterclockwise rotation of the ratchet wheel 44, to allow the same rotation of the wheel 44.

Figure 6:
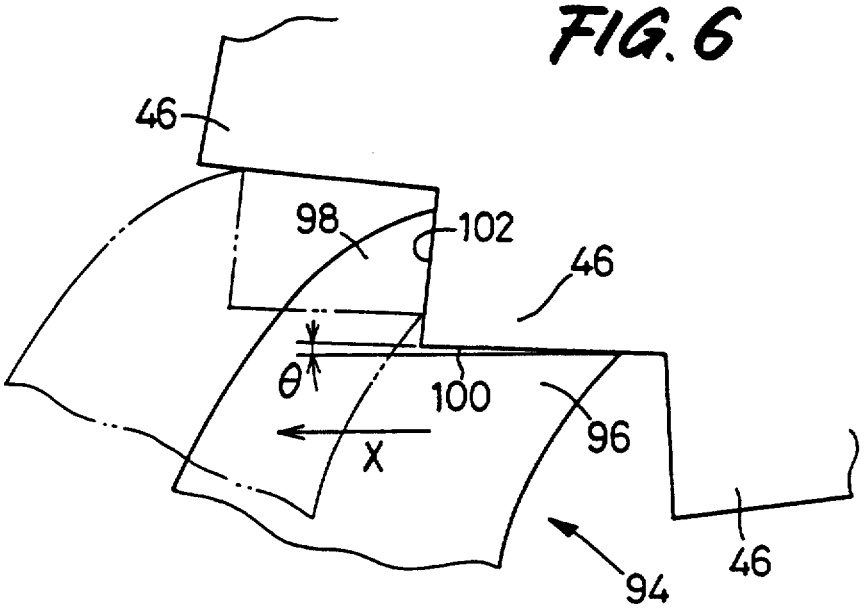
FIG. 6 is a fragmentary view showing a ratchet device as another embodiment of the present invention.

Referring next to FIG. 6, there is shown another embodiment of the present invention, which is different from the first embodiment in that the feed pawl 60 has an engaging portion in the form of a forked tip 94 having a first and a second branch 96, 98. This forked tip 94 is shaped such that the first and second branches 96, 98 engage opposite tooth faces 100, 102 of one of the teeth 46 of the ratchet wheel 44, respectively, when the feed pawl 60 is placed in its fully retracted position, i.e., when the feed pawl 60 is held in contact with the stopper surface 90 of the stopper member 92.

In this condition, the tooth face 100 of the one tooth 46 which faces the first branch 96 of the tip 92 is inclined a small angle $\theta$ with respect to a line parallel to a direction indicated by an arrow "X" in which the feed pawl 60 is moved at the fully retracted position toward the fully advanced position, such that a distance between the tooth face 100 and the line is increased in a direction toward a tip of the above one tooth 46. In this arrangement, the forked tip 94 of the feed pawl 60 is easily disengaged from the relevant tooth 46 of the ratchet wheel 44 upon movement of the feed pawl 60 from the fully retracted position to the fully advanced position. However, the tooth face 100 facing the first branch 96 of the tip 94 may extend in a line substantially parallel to the above-indicated direction X.

In the case where the carrier tape 12 is fed in increments of 4 mm, the drive bar 74 is pivoted about the shaft 89 instead of the shaft 78, to increase the distance of movement of the drive plate 70 so that the feed pawl 60 can pass two of the teeth 46 of the ratchet wheel 44 during one stroke of the plate 70. Alternatively, the support lever 48 is adapted to effect two reciprocations between the first and second positions so that the feed pawl 60 can pass one tooth 46 during each reciprocation of the lever 48.

While a stationary stopper member like the stopper member 92 used in the illustrated embodiment is available at a relatively low cost, it may be replaced by a bolt or other stopper member whose position is suitably adjustable.

While the teeth 46 are formed on the outer circumferential surface of the ratchet wheel 44 in the illustrated embodiment, the teeth may be formed on a side face or faces of the wheel 44.

While the support lever 48 serving as the support member is pivotable about a horizontal axis in the illustrated embodiment, the lever 48 may be replaced by a member which is linearly moved in the longitudinal direction of the feed pawl 60.

Where the support member is linearly moved in the longitudinal direction thereof, the support member may be adapted to hold the feed pawl such that the pawl is movable in a direction perpendicular to the direction of movement of the support member, and such that the feed pawl is biased away from the support member by a suitable biasing means, for engagement of the pawl with the teeth of the ratchet wheel, so that the ratchet wheel is rotated by the movements of the support member and the pawl.

In the illustrated embodiment, the ratchet wheel 44 is coaxially fixed to the sprocket wheel 40 such that the wheels 40, 44 are rotated as a unit about the same axis. However, it is possible to provide a gear device or other power transmitting system between the sprocket and ratchet wheels for transmitting a rotary motion therebetween, provided the amount of rotation of the ratchet wheel is proportional to that of the sprocket wheel.

While the ratchet device of the instant embodiment is used to rotate the sprocket wheel 40 to thereby feed the carrier tape 12 carrying the electronic components 22, the ratchet device according to the present invention may be used in other intermittently feeding or rotating apparatus.

While the present invention has been described in its presently preferred embodiment, for illustrative purpose only, it is to be understood that the invention is not limited to the details of the illustrated embodiment, but may be embodied with various other changes, modifications and improvements, which may occur to those skilled in the art, without departing from the scope of the invention defined in the following claims.

What is claimed is:

1. An apparatus for feeding a carrier tape, which has electronic components spaced apart from each other in a longitudinal direction of the carrier tape, said carrier tape having equi-spaced feed holes arranged in said longitudinal direction, said apparatus comprising:

a body;

a sprocket wheel rotatably supported by said body and having a plurality of teeth engageable with said feed holes of said carrier tape;

a ratchet wheel rotatably supported by said body and having a plurality of teeth, said ratchet wheel being connected to said sprocket wheel, for rotating said sprocket wheel;

a feed pawl having an engaging portion engageable with said teeth of said ratchet wheel;

a support member movably supported by said body, for movably holding said feed pawl such that said engaging portion is movable in a direction toward and away from said teeth of said ratchet wheel;

biasing means for biasing said feed pawl toward said teeth of said ratchet wheel for engagement of said engaging portion with said teeth;

drive means for moving said support member between a first portion for placing said feed pawl in a fully advanced position, and a second position for placing said feed pawl in a fully retracted position, said engaging portion of said feed pawl passing at least one of said teeth of said ratchet wheel when said support member is moved from said second position to said first position, and rotating said ratchet wheel in one direction by a predetermined angle corresponding to the number of said at least one of said teeth, while engaging a last tooth of said at least one of said teeth which said feed pawl has passed last, when said support member is moved form said first position to said second position;

a stationary rigid stopper member formed integrally with said body, and having a stopper surface for contact with said feed pawl when said support member is moved to said second position, for preventing said engaging portion of said feed pawl from disengaging from said last tooth of said ratchet wheel; and said engaging portion of said feed pawl being shaped so that the engaging portion engages mutually opposed tooth faces of said ratchet wheel when said feed pawl is held in contact with said stopper surface, to thereby lock said ratchet wheel against clockwise and counterclockwise rotations thereof.

2. An apparatus according to claim 1, wherein said mutually opposed tooth faces consist of mutually facing tooth faces of two adjacent teeth of said teeth of said ratchet wheel, said two adjacent teeth consisting of said last tooth and a tooth adjacent to said last tooth in a direction opposite to said one direction.

3. An apparatus according to claim 1, wherein said mutually opposed tooth faces consist of opposite tooth faces of one of said teeth of said ratchet wheel.

4. An apparatus according to claim 1, wherein said mutually opposed tooth faces consist of a tooth face of one of said teeth of said ratchet wheel, and one of two opposite tooth faces which adjoin to said tooth face, said tooth face extending in a line substantially parallel to a direction in which said feed pawl is moved at said fully retracted position toward said fully advanced position.

5. An apparatus according to claim 1, wherein said mutually opposed tooth faces consist of a tooth face of one of said teeth of said ratchet wheel, and one of two opposite tooth faces which adjoin to said tooth face, said tooth face being inclined a small angle with respect to a line parallel to a direction in which said feed pawl is moved at said fully retracted position toward said fully advanced position, such that a distance between said tooth face and said line is increased toward a tip of said one tooth of said ratchet wheel.

6. An apparatus according to claim 1, wherein said feed pawl is pivotable about an axis distant from said engaging portion when said feed pawl is moved from said fully advanced position to said fully retracted position.

7. An apparatus according to claim 1, wherein said support member consists of a pivotable lever which is pivotable between said first and second positions, about a lever axis parallel to a wheel axis of said ratchet wheel, said feed pawl being connected to said pivotable lever pivotably about a pawl axis parallel to said lever axis.

8. An apparatus according to claim 1, wherein said drive means comprises a drive plate pivotably connected at one of opposite ends thereof to said support member, and a drive bar pivotably supported by said body and connected to the other end of said drive plate, for reciprocating said drive plate to move said support member between said first and second positions of said support member.

9. An apparatus according to claim 8, wherein said drive means further comprises a spring for biasing said drive plate for biasing said support member toward said second position.

10. An apparatus according to claim 1, further comprising a detent pawl pivotably supported by said body for preventing said ratchet wheel from rotating in the direction opposite to said one direction.

11. An apparatus according to claim 5, wherein said biasing means comprises a spring connected to said feed pawl and said detent pawl for biasing the feed and detent pawls toward each other for engagement with said teeth of said ratchet wheel.

12. An apparatus according to claim 1, wherein said plurality of teeth are formed on an outer circumferential surface of said ratchet wheel.

13. An apparatus for feeding a carrier tape which has electronic components spaced apart from each other in a longitudinal direction of the carrier tape, said carrier tape having equi-spaced feed holes arranged in said longitudinal direction, said apparatus comprising:

a body;

a sprocket wheel rotatably supported by said body and having a plurality of teeth engageable with said feed holes of said carrier tape;

a ratchet wheel rotatably supported by said body and having a plurality of teeth, said ratchet wheel being connected to said sprocket wheel, for rotating said sprocket wheel;

a feed pawl having an engaging portion engageable with said teeth of said ratchet wheel, and being pivotable about a pawl axis parallel to a wheel axis of said ratchet wheel;

a pivotable lever supported by said body pivotally between a first position for placing said feed pawl in a fully advanced position and a second position for placing said feed pawl in a fully retracted position, about a lever axis parallel to said pawl axis of said feed pawl, and connected to said feed pawl such that said engaging portion is movable in a direction toward and away from said teeth of said ratchet wheel;

biasing means for biasing said feed pawl toward said teeth of said ratchet wheel for engagement of said engaging portion with said teeth;

drive means comprising (a) a drive plate pivotally connected at one of opposite ends thereof to said pivotable lever, (b) a drive source connected to the other end of said drive plate, for moving said drive plate in a direction substantially parallel to a feeding direction of said carrier tape, for pivoting said pivotable lever from said second position to said first position, to thereby move said feed pawl to said fully advanced position, so that said engaging portion of said feed pawl passes at least one of said teeth of said ratchet wheel when said support member is moved from said second position to said first position, and (c) a spring member for biasing said pivotable lever toward said second position, to thereby return said feed pawl to said fully retracted position so that said ratchet wheel is rotated in one direction by a predetermined angle corresponding to the number of said at least one of said teeth, while engaging a last tooth of said at least one of said teeth which said feed pawl has passed last;

a stopper member provided on said body, for contact with said feed pawl when said pivotable lever is placed in said second position, for preventing said engaging portion of said feed pawl from disengaging from said last tooth of said ratchet wheel; and said engaging portion of said feed pawl being shaped so that the engaging portion engages mutually opposed tooth faces of said ratchet wheel when said feed pawl is held in contact with said stopper member, to thereby lock said ratchet wheel against clockwise and counterclockwise rotations thereof.

14. An apparatus according to claim 13, wherein said mutually opposed tooth faces consist of mutually facing tooth faces of two adjacent teeth of said teeth of said ratchet wheel, said two adjacent teeth consisting of said last tooth and a tooth adjacent to said last tooth in a direction opposite to said one direction.

15. An apparatus according to claim 13, wherein said mutually opposed tooth faces consist of opposite tooth faces of one of said teeth of said ratchet wheel.

16. An apparatus according to claim 13, wherein said sprocket wheel and said ratchet wheel are coaxial with each other.

17. An apparatus according to claim 13, further comprising a presser member supported by said body, and wherein said body has a sliding surface on which said carrier tape is slidably moved in sliding contact with said presser member.

18. An apparatus according to claim 17, wherein said sprocket wheel is located so that said teeth of the sprocket wheel engage said feed holes in a portion of said carrier tape which is in sliding contact with said presser member.

19. An apparatus according to claim 13, wherein an angle of rotation of said ratchet wheel by a movement of said feed pawl from said fully advanced position to said fully retracted position corresponds to a spacing of said feed holes of said carrier tape in said longitudinal direction.

20. An apparatus according to claim 19, wherein a distance between said first and second positions of said pivotable lever is determined so that said at least one of said teeth of said ratchet wheel consists of one tooth.

21. An apparatus for feeding a carrier tape which has electronic components spaced apart from each other in a longitudinal direction of the carrier tape, said carrier tape having equi-spaced feed holes arranged in said longitudinal direction, said apparatus comprising:

a body;

a sprocket wheel rotatably supported by said body and having a plurality of teeth engageable with said feed holes of said carrier tape;

a ratchet wheel rotatably supported by said body and having a plurality of teeth, said ratchet wheel being connected to said sprocket wheel, for rotating said sprocket wheel;

a feed pawl having an engaging portion engageable with said teeth of said ratchet wheel, and being pivotable about a pawl axis parallel to a wheel axis of said ratchet wheel;

a pivotable lever supported by said body pivotally between a fist position for placing said feed pawl in a fully advanced position and a second position for placing said feed pawl in a fully retracted position, about a lever axis parallel to said pawl axis of said feed pawl, and connected to said feed pawl such that said engaging portion is movable in a direction toward and away from said teeth of said ratchet wheel;

biasing means for biasing said feed pawl toward said teeth of said ratchet wheel for engagement of said engaging portion with said teeth;

drive means comprising (a) a drive plate pivotally connected at one of opposite ends thereof to said pivotable lever, (b) a drive bar pivotally supported by said body and connected to the other end of said drive plate, for moving said drive plate in a direction substantially parallel to a feeding direction of said carrier tape, for pivoting said pivotable lever from said second to said first position, to thereby move said feed pawl to said fully advanced position, so that said engaging portion of said feed pawl passes at least one of said teeth of said ratchet wheel when said pivotable lever is pivoted from said second position to said first position, and (c) a spring member for biasing said pivotable lever toward said second position, to thereby return said feed pawl to said fully retracted position so that said ratchet wheel is rotated in one direction by a predetermined angle corresponding to the number of said at least one of said teeth, while engaging a last tooth of said at least one of said teeth which said feed pawl has passed last;

means for selecting one of a plurality of pivot axes about which said drive bar is pivoted, said plurality of pivot axes being spaced from each other in a longitudinal direction of said drive bar so that a pivoting angle of said pivotable lever and said predetermined angle of rotation of said ratchet wheel are changed depending upon a selected one of said pivot axes;

a stopper member provided on said body, for contact with said feed pawl when said pivotable lever is placed in said second position, for preventing said engaging portion of said feed pawl from disengaging from said last tooth of said ratchet wheel; and said engaging portion of said feed pawl being shaped so that the engaging portion engages mutually opposed tooth faces of said ratchet wheel when said feed pawl is held in contact with said stopper member, to thereby lock said ratchet wheel against clockwise and counterclockwise rotations thereof.

* * * * *